US009050653B2

(12) United States Patent
Bigger et al.

(10) Patent No.: US 9,050,653 B2
(45) Date of Patent: Jun. 9, 2015

(54) SUCTION VALVE DEVICE FOR DISCHARGING GAS FROM A MOULD

(75) Inventors: René Bigger, Brent (CH); Christophe Bagnoud, Martigny (CH)

(73) Assignee: V.D.S. Vacuum Diecasting Service S.A. (CH)

( * ) Notice: Subject to any disclaimer, the term of this patent is extended or adjusted under 35 U.S.C. 154(b) by 0 days.

(21) Appl. No.: 14/123,937

(22) PCT Filed: Jun. 1, 2012

(86) PCT No.: PCT/IB2012/052781

§ 371 (c)(1),
(2), (4) Date: Dec. 4, 2013

(87) PCT Pub. No.: WO2012/168841

PCT Pub. Date: Dec. 13, 2012

(65) Prior Publication Data

US 2014/0102658 A1 Apr. 17, 2014

(30) Foreign Application Priority Data

Jun. 9, 2011 (CH) ..... 0978/11

(51) Int. Cl.
*B22D 17/14* (2006.01)

(52) U.S. Cl.
CPC ..... *B22D 17/145* (2013.01); *B22D 17/14* (2013.01)

(58) Field of Classification Search
CPC ..... B22D 17/14; B22D 17/145
USPC ..... 164/155.4, 305, 410
See application file for complete search history.

(56) References Cited

U.S. PATENT DOCUMENTS 4,691,755 A 9/1987 Kuriyama et al.
4,770,225 A * 9/1988 Takagi et al. ..... 164/305

(Continued)

FOREIGN PATENT DOCUMENTS

EP 0612573 B1 3/1998
EP 0936009 A1 8/1999

OTHER PUBLICATIONS

International Bureau, International Search Report issued on Patent Application No. PCT/IB2012/052781 on Dec. 10, 2013.
Breitinger, R., Formentluftung bei DruckgieBwerkzeugen, GieBerei-Praxis, Feb. 25, 1982, p. 53-58, Berlin.

(Continued)

*Primary Examiner* — Kevin E Yoon
(74) *Attorney, Agent, or Firm* — Perkins IP Law Group LLC; Jefferson Perkins

(57) ABSTRACT

The invention relates to a valve device for a pressure injection or die-casting machine, said device comprising a body (18) with a valve chamber (21) including a suction chamber and a control chamber, and a sliding valve (20) mounted in the valve chamber, said sliding valve comprising a first portion (34) with a valve head (44) that co-operates with a valve seat (22) on the body in order to open and close the valve and a second portion (35) comprising a piston (38) mounted in the control chamber (21*a*). The control chamber is connected to fluid control connections (26*a*, 26*b*) in order to exert a pressure on the piston (38) so as to control the opening and closing of the valve. The second valve portion and the first valve portion are aligned on the same axis in the direction of movement of the sliding valve and said first and second portions of the sliding valve can be separated from one another and secured to one another using a removable securing member (36, 36').

14 Claims, 7 Drawing Sheets

(56) References Cited

U.S. PATENT DOCUMENTS

Figure 1:
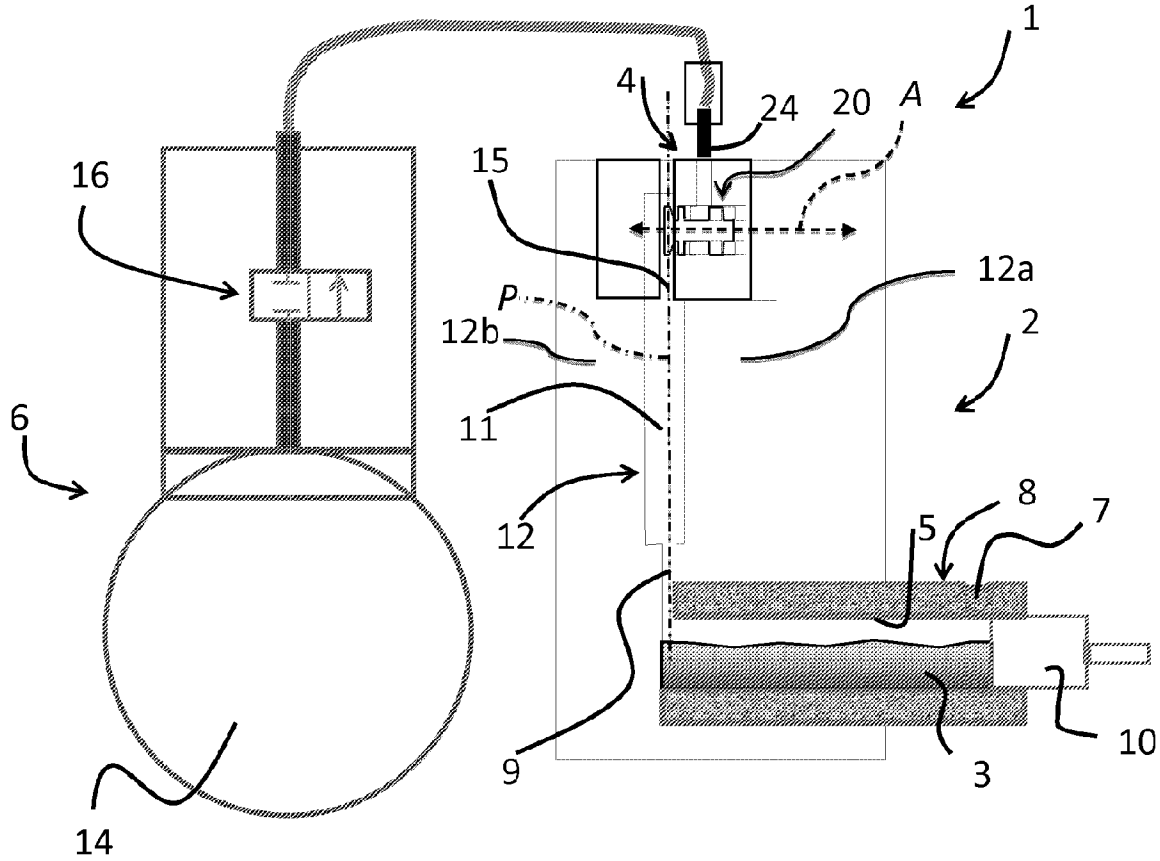

| | | | | |
|---|---|---|---|---|
| 4,997,026 | A | 3/1991 | Ozeki et al. | |
| 5,488,985 | A | 2/1996 | Wyser | |
| 6,158,495 | A | 12/2000 | Bigger | |
| 6,823,930 | B2 * | 11/2004 | Wuethrich | 164/305 |
| 2004/0256074 | A1 * | 12/2004 | Kubota | 164/347 |
| 2011/0088866 | A1 * | 4/2011 | Mizukusa et al. | 164/305 |

OTHER PUBLICATIONS

European Patent Office as International Searching Authority, International Search Report issued on Application No. PCT/IB2012/052781 on Jul. 12, 2013.

European Patent Office as International Searching Authority, International Search Report and Written Opinion of ISA issued on PCT/IB2012/052781 on Jul. 12, 2013.

* cited by examiner

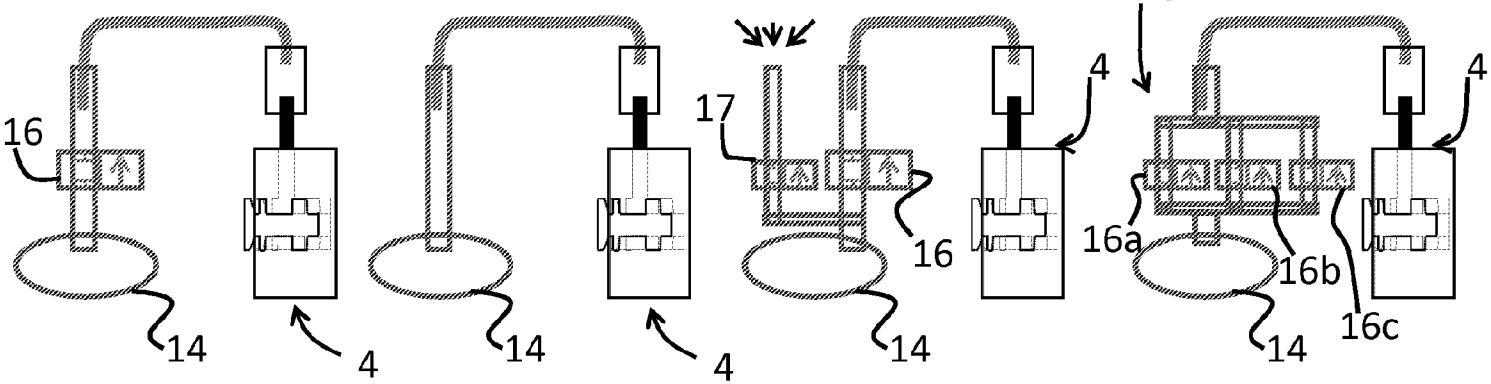
FIG 4a
FIG 4b
FIG 4c
FIG 4d
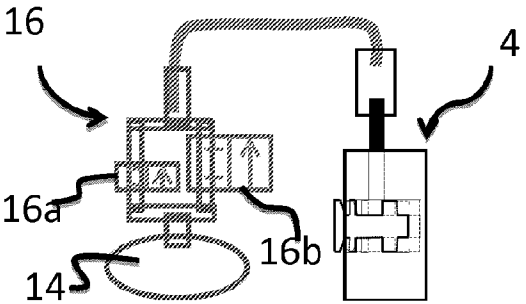
FIG 4e

SUCTION VALVE DEVICE FOR DISCHARGING GAS FROM A MOULD

The present invention relates to a suction valve device for the discharge of gas from a mould, especially from a mould for the die-casting of liquid metals, or for the injection of plastic material.

A differential valve for the discharge of gas from a die-casting mould of liquid metals is described in European patent EP 936009. Die-casting of liquid metals produces moulded items of complex form in metal alloy such as alloys of aluminium, magnesium, zinc, zamak or other injection materials. It is important to inject the still-liquid metal into the mould very rapidly to ensure that the mould fills entirely with a minimum of solidification of the metal caused by contact with the wall of the mould, also to ensure homogeneous properties after solidification of the injected material. The suction valve discharges air contained in the mould before and during injection of the liquid material into the mould, the valve being connected to a vacuum tank to create a partial vacuum in the mould cavity by sucking air out of the mould. Due to injection speeds, the valve must be reactive and very precise, and also be reliable and economical. Due to possible soiling of the valve and wear of some parts during use, it is preferable to have a valve which keeps maintenance costs low and which can be exchanged quickly for its replacement or for cleaning.

Moulds for die-casting of liquid metals comprising a valve device for the discharge of gas are described for example in patents U.S. Pat. Nos. 4,691,755 and 4,997,026. In these devices, the valve is arranged at the top of the mould, the axis of displacement of the piston of the valve being vertical and perpendicular to the axis of displacement of the opening of the mould for extracting the cast piece. Said otherwise, the axis of displacement of the piston of the valve is parallel to the plane of separation (also called joint plane) of the two parts of the mould. The valve device for the discharge of gas is arranged therefore above the two parts of the mould, these two parts being separable for extraction of the cast piece. A disadvantage of this configuration is that the mould must have a device for raising the valve device to separate the two mould parts. Also, for carrying out cleaning or replacement operations of the pieces of the valve, especially the piston, the valve head and the valve seat, entry is made at the part rear of the device, that is, the end opposite the valve head, to dismantle the valve. This results in carrying out disassembly by passing through the control chamber. Disassembly at the level of the control chamber, given the joints and tolerances, makes maintenance procedures long and complex, sharply increasing operating costs, given the fact that during maintenance and repairing of valves the machine is idle. The downtime of a machine has a considerable impact on the manufacturing costs of pieces.

In conventional solutions such as described in U.S. Pat. Nos. 4,691,755 and 4,997,026 the orientation of the axis of the piston of the valve, parallel to the plane of separation of the two parts of the mould, also has the disadvantage of needing a jack for raising the valve device during opening of the mould, this jack being costly to maintain and reducing the reliability of the machine.

Due to the different items to be moulded and therefore the different volumes and types of moulds which can be installed on the machine, variable and fine control of suction as a function of the injection data and the volume of gas in the mould would be advantageous.

In light of the above, an aim of the invention is to provide a valve device for discharge of gas from a die-casting or plastic injection mould, which is reliable and which allows controlled and rapid evacuation of air and other gases in the mould.

It is advantageous to provide a valve device for discharge of gas from a die-casting or plastic injection mould which is easy and economical to upkeep and replace.

It is advantageous to provide a suction valve device for a die-casting or injection mould which allows rapid and easy exchange of worn, clogged or damaged parts and which allows easy cleaning of pieces soiled by the circulation of gas dirtied during suction (lubricants, greases, combustion gases). In particular, it is advantageous to provide a valve device for a die-casting or injection machine which reduces the idle time of the machine during replacement or upkeep of valve parts.

It is advantageous to provide a valve for the discharge of gas from a die-casting or injection mould which can be finely controlled to vary the gas suction rate before and during injection of liquid material, especially between the start of injection and the finish of injection.

Aims of the invention are realised by the suction valve device according to claim 1.

In the present invention, a suction valve device for die-casting or plastic injection machine is described, comprising a body with a valve chamber comprising a suction chamber and a control chamber, and a sliding valve mounted in the valve chamber. The sliding valve comprises a first part with a valve head cooperating with a valve seat on the body for the opening and the closing of the valve, and a second part comprising a piston mounted in the control chamber, the control chamber being connected to fluid control connections for exerting force on the piston for controlling the opening and closing of the valve. The second valve part and the first valve part are aligned on the same axis in the direction of displacement of the sliding valve, transversal to the plane of separation of the moulds, the first and second parts of the sliding valve being separable. In advantageous embodiments, the first and second parts of the sliding valve are joined together by a removable securing member. In another variant, the first and second parts of the sliding valve are joined together by being screwed to each other, for example by having a male thread on a part engaged in a female thread in the other part.

The valve device according to the invention reduces the downtime of the machine during maintenance of the valve, for example for cleaning or replacement of the valve head, and increases the reliability of the device. In fact, having the valve device such that the direction of displacement of the piston is transversal to the plane of separation of the moulds, and having the valve head separable from the valve piston and configured to withdraw the valve head from the side of the face of the mould, the valve head can quickly be removed without taking action on the control chamber by carrying out very simple operations. Also, with this configuration there is no need to displace the valve device during opening of the mould, avoiding the necessity to have a jack or other system for displacement of the valve device.

Also, since the valve device according to the invention is not bulky and heavy, the user will be able to procure a reserve valve device for rapid exchange during a maintenance operation. The valve device according to the invention can be inserted into the mould in chosen positions, as compared to conventional moulds such as described in U.S. Pat. Nos. 4,691,755 and 4,997,026 which must be arranged at the periphery of the mould.

The invention maximises the suction cross-section for faster discharge of gas of large footprints, due to its control device which enables rapid and extremely sure closing even for a very large suction cross-section.

In a first advantageous embodiment, the removable securing member comprises a pin inserted transversally in a bore passing through the first and second parts of the sliding valve. The body comprises openings on either side of the sliding valve configured for axial displacement of the pin during opening and respectively closing of the valve. The openings in the body can be closed by screws mounted in threaded holes in the body and configured to place the end of the screws at slight clearance from the ends of the pin to allow sliding of the pin.

In a second embodiment, the securing member comprises a screw, for example a screw aligned with a central axis in the sliding valve passing through one of the parts and engaging in the other part with a thread.

The valve device can advantageously comprise a sleeve mounted in the chamber of the body, the sleeve defining a surface for guiding and sliding of the sliding valve, as well as the valve seat, the sleeve being mounted removably on the body. According to an advantageous embodiment, the body comprises a first part and a second part, the first part being mounted removably on the second part, the first part comprising a connection for connection to a vacuum-generation system, and the second part comprising the control chamber.

In an advantageous embodiment, the piston has an opening face with a surface wider than a closing face of the other side of the piston, configured to apply differential pressure to the piston, at least in part compensating pressure on the valve head during discharge of gas.

In an embodiment, the valve head has a conical surface complementary to a conical surface of the valve seat.

In another embodiment, the valve head has a cylindrical surface complementary to a cylindrical surface in the valve seat.

In the present invention, a die-casting system comprising a die-casting machine with a valve device is also described, as is a vacuum-generation system comprising a vacuum tank having a volume greater than a volume of gas to be suctioned from a mould mounted on the machine. According to an embodiment, the vacuum-generation system comprises at least one principal valve for controlling the opening and closing of the connection between the tank and the valve device. In a variant, the vacuum-generation system comprises a plurality of principal valves between the vacuum tank and the valve device, the principal valves able to be controlled for delayed opening or closing to control the suction rate. In another embodiment, the vacuum-generation system comprises a valve connected to the atmospheric pressure to decrease the suction rate during a first injection phase.

In the present invention, a process for die-casting a liquid metal arranged in a tank connected by an output to a cavity of the form of a mould is also described. The process comprises a first suction gas step of the mould and of the tank at a first speed and simultaneously a reduction in the volume in the chamber of the tank, and a second suction gas step at a second speed greater than the first speed when the volume of the chamber is more reduced, and optionally a third suction gas step at a third speed greater than the second speed when the volume of the chamber is very reduced or when the liquid starts to be injected into the cavity of the mould.

In an embodiment, the variation in suction speed can advantageously be controlled at least partially by the degree of opening of the valve of the valve device.

In another embodiment, the variation in suction speed can advantageously be controlled at least partially by a plurality of principal valves of a vacuum-generation system comprising a vacuum tank connected to said mould, the plurality of principal valves being arranged between the vacuum tank and the valve device and able to be controlled independently for delayed opening or closing to control the suction rate.

The second suction step can be commenced when the liquid metal to be cast has not yet entered the cavity of the mould. If a third suction gas step is implemented, it can occur when the non-filled volume of liquid metal in the chamber of the tank is greatly reduced or when the liquid starts to be injected into the cavity of the mould. The increase in suction speed can be realised in three or more than three steps of variation in speed by controlling the degree of opening of the valve of the valve device, and/or by controlling the opening of one or more principal valves of a vacuum-generation system. The variation of the suction speed can therefore also be controlled at least in part by a valve system connected to the tank of a vacuum-generation system.

In an advantageous aspect of the invention, one or more suction cross-sections of one or more output channels connecting the cavity of the mould to the valve device are configured to create a pressure drop at the gas rate as a function of the volume of gas to be suctioned to be able to employ the valve device for a plurality of volumes of liquids with volumes which can vary by an order of magnitude.

Figure 2A:
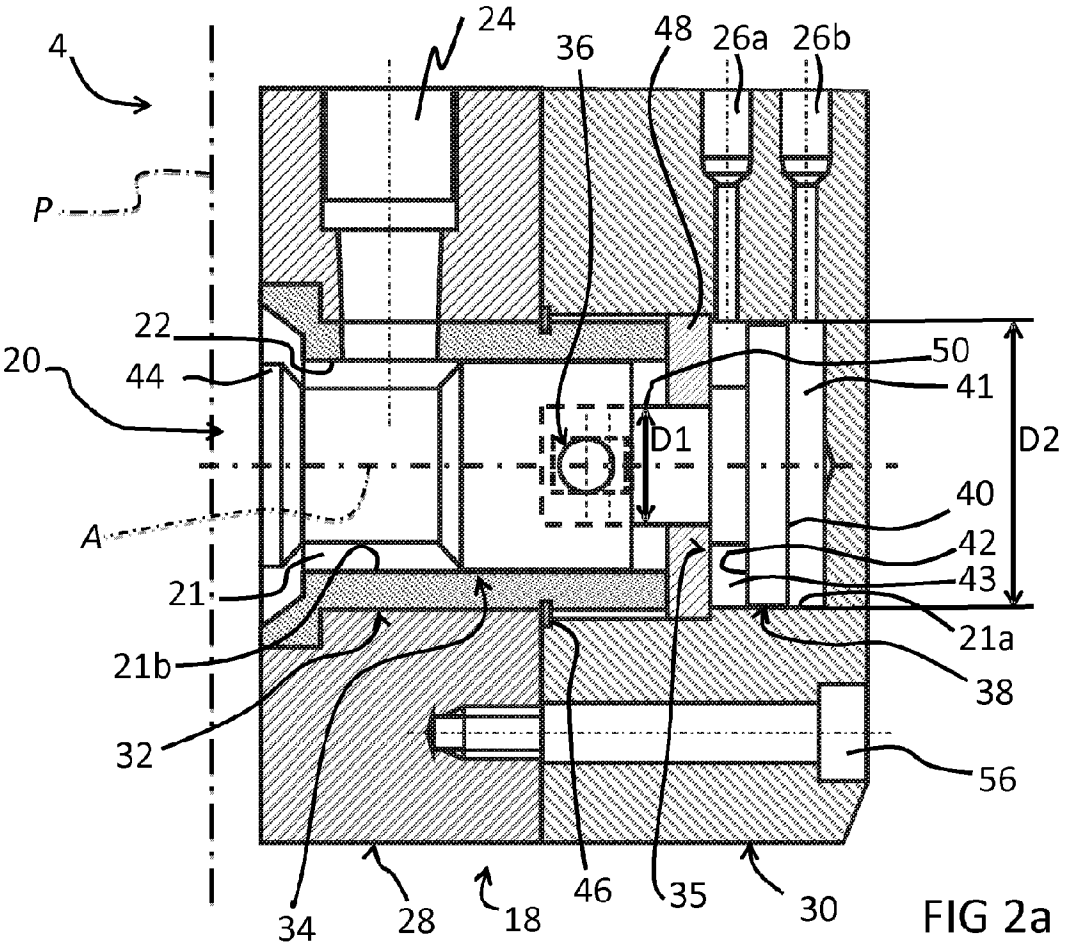
Figure 2B:
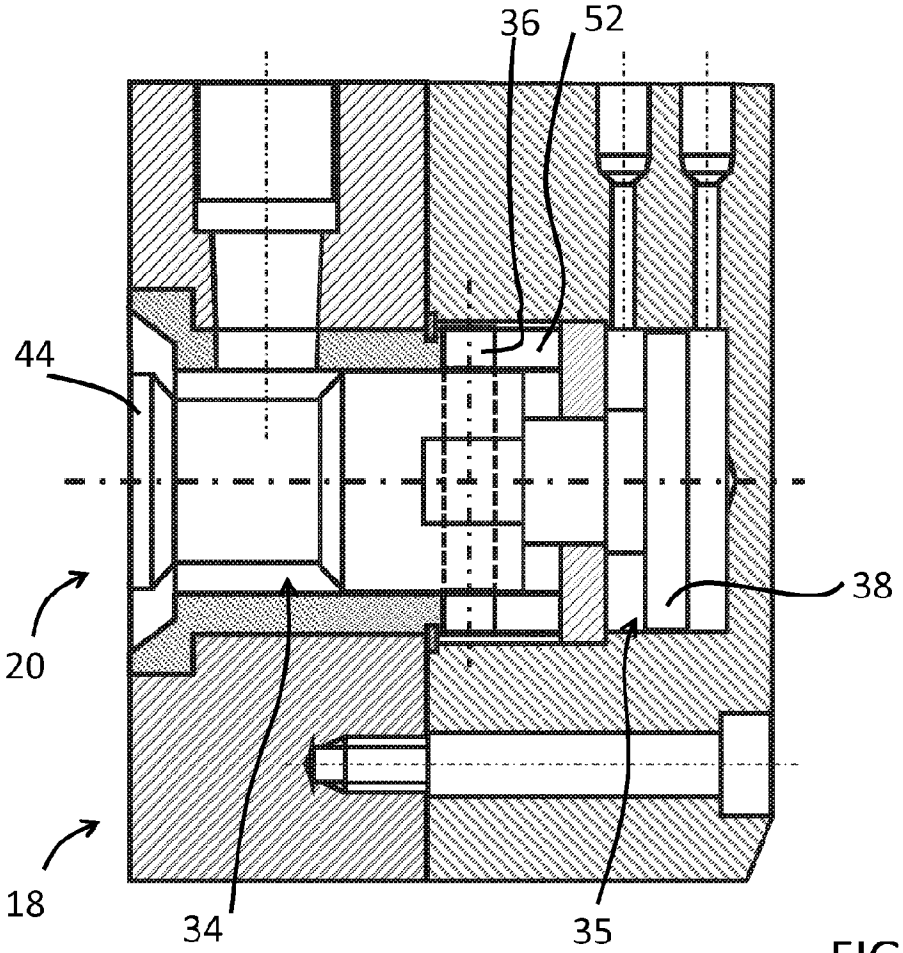
Figure 2D:
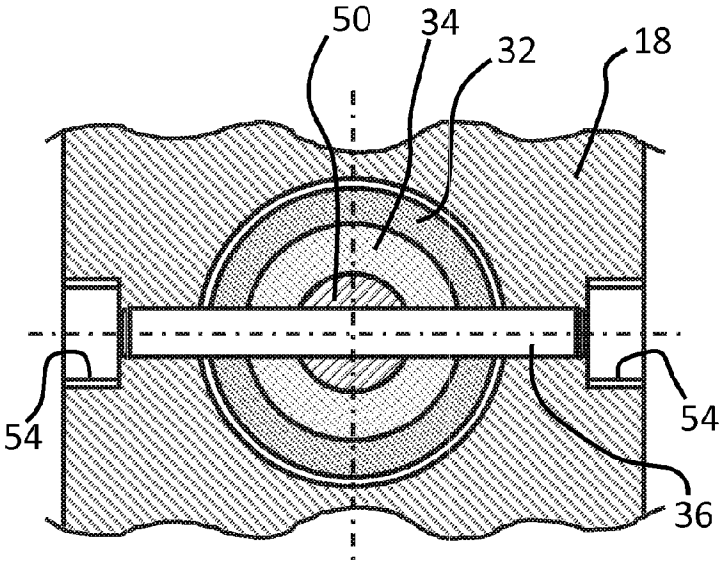
Figure 2C:
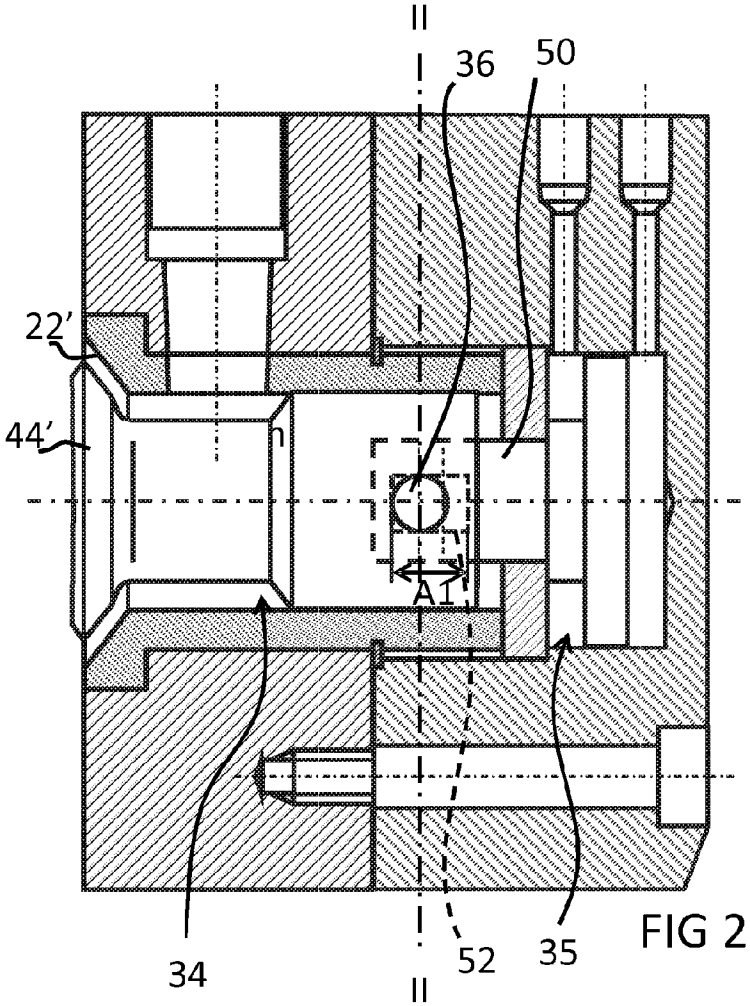

Other aims and advantageous aspects of the invention will emerge from the claims, the detailed description of embodiments hereinbelow, and the attached diagrams, in which:

FIG. 1 is a schematic illustration of a die-casting or plastic injection system according to an embodiment;

FIG. 2*a* is a sectional view of a suction valve device according to a first embodiment with cylindrical valve head and cylindrical coupling with pin with the piston;

FIG. 2*b* is a sectional view of a valve device according to an embodiment with cylindrical valve head and coupling in the form of a fork with pin with the piston;

FIG. 2*d* is a sectional view according to the line 11-11 of FIG. 2*c;*

Figure 3A:
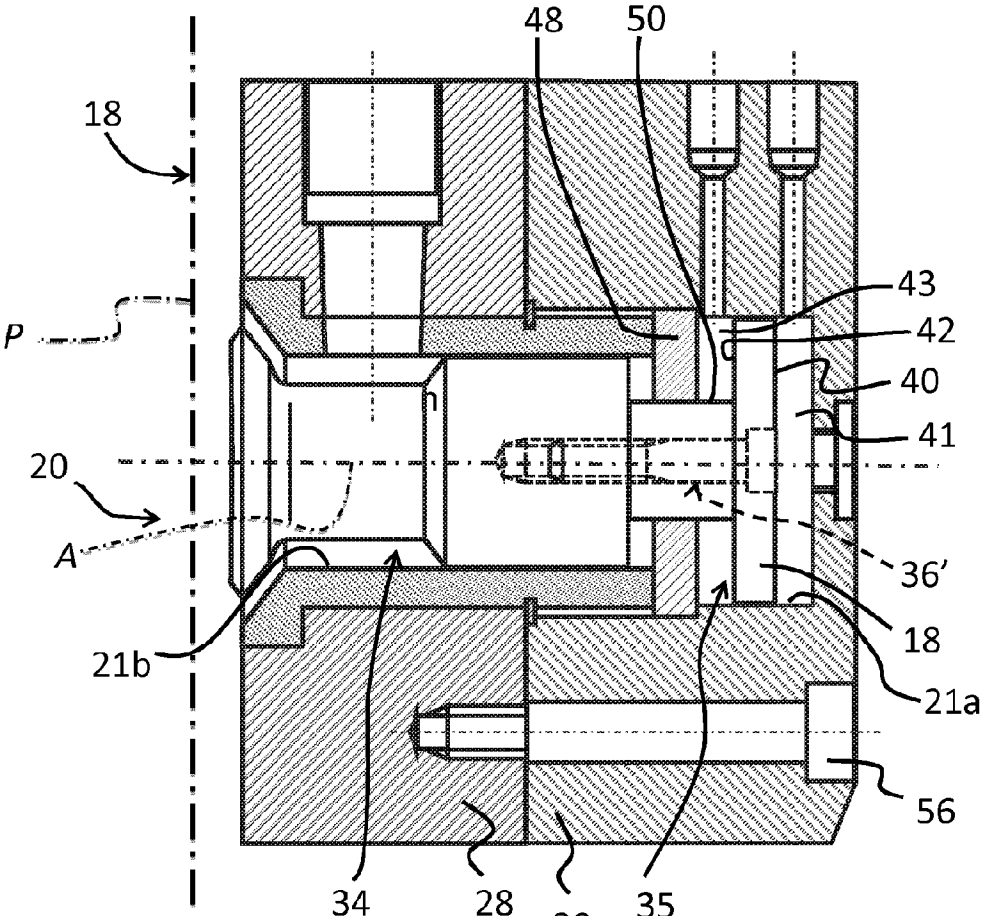
Figure 3B:
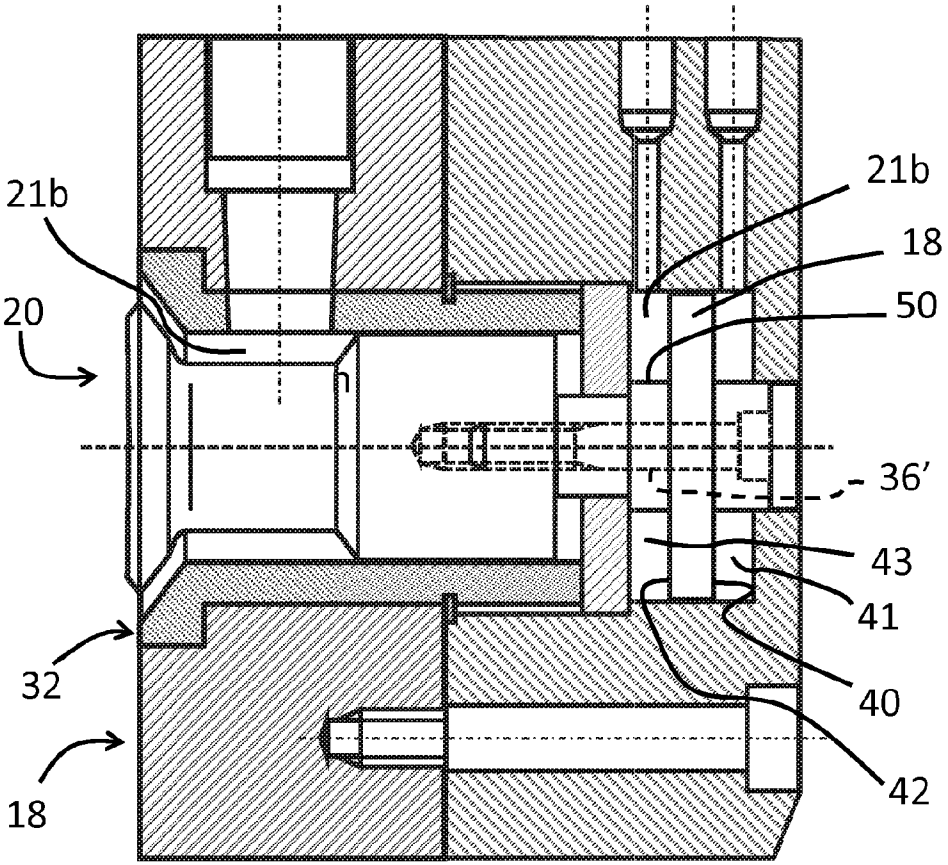

FIG. 3*a* is a sectional view of a valve device according to a second embodiment of the invention;

FIG. 3*b* is a sectional view of a valve device according to a variant of the embodiment of FIG. 3*a;*

FIGS. 4*a* to 4*d* schematically illustrate die-casting or plastic injection systems according to different variants:

FIG. 4*a* shows the variant illustrated in FIG. 1, where the die-casting machine is connected to a vacuum tank by a principal valve;

FIG. 4*b* illustrates a variant where the machine is connected to a vacuum tank without principal valve;

FIG. 4*c* illustrates a variant where the machine is connected to a vacuum tank by a principal valve, the tank being connected to the ambient air via a second valve;

FIG. 4*d* illustrates a variant where the die-casting machine is connected to a tank in partial vacuum by a plurality of valves controlled independently or sequentially; and FIG. 4*e* illustrates a variant where the die-casting machine is connected to a tank in partial vacuum by two valves of different sizes controlled independently or sequentially.

First in reference to FIG. 1, a system die-casting or plastic injection 1 comprises a die-casting or injection machine 2, a vacuum-generation system 6 and a gas suction valve device 4 mounted on the machine 2 and communicating with the vacuum-generation system 6 via a gas discharge connection 24. The vacuum-generation system comprises a tank 14 forming a chamber with a volume greater than the volume of gas in the mould to be suctioned, the chamber being connected to a vacuum pump (not illustrated) creating a partial vacuum in the tank. The vacuum-generation system can also comprise a principal valve 16 which can be controlled to open and close the conduit interconnecting the valve device to the tank 14. The vacuum-generation system discharges air from the mould very quickly before and during injection of a liquid material into the mould.

The die-casting or injection machine 2 comprises a reservoir 8 with a chamber 5 for containing the liquid material to be cast or injected 3, a mould 12 defining a cavity of form 11 to form the piece to be cast, the cavity of form 11 being in communication with the valve device 4 arranged at the top of the mould on one of the parts of the mould. The mould comprises at least two parts 12*a*, 12*b* separable so as to remove the moulded piece. The valve device is configured to be arranged on one of the parts 12*a* of the mould and is oriented such that the axis A of a sliding valve 20 of the device (defining the direction of displacement of the sliding valve) is transversal to the plane of separation P of the moulds. In a preferred embodiment, the direction transversal is perpendicular to the plane of separation P of the mould parts. The transversal direction can however comprise an angle other than perpendicular (90°) to the plane of separation P, for example an angle between 90° and 45°, without departing from the scope of the invention.

The chamber 5 comprises an inlet 7 for filling the chamber 5 with liquid 3, and an output 9 between the chamber 5 and the cavity of form 11 for passage of the liquid from the chamber 5 to the cavity of form 11 during the casting or injection step. The reservoir 8 comprises a piston 10 for pushing the liquid 3 from the chamber 5 into the cavity of form 11 of the mould.

In some applications, the liquid material is a liquid metal such as an alloy of aluminium, magnesium or yet other injected metals, the machine being adapted to die-casting of metals. Other materials such as plastics could also be injected by a process according to the invention, and it is also feasible to replace the tank of liquid material 8 by other liquid-supply systems.

In a die-casting process, the liquid material 3 is poured in via the inlet 7 into the chamber 5 of the reservoir 8. Next the piston 10 advances to close the inlet 7. Then, the valve device is opened and the air contained in the cavity of form 11 of the mould is suctioned by the vacuum-generation system 6, the principal valve 16 at this moment also being open, and simultaneously the piston 10 is advanced first to lift the level of liquid material 3 in the chamber 5 of the reservoir 8 then to push the liquid 3 in the cavity of form 11 of the mould. The valve of the device 4 is closed just before complete filling of the cavity of form 11 of the mould, or when the liquid material is in one or more output channels 15 connecting the cavity of form 11 to the valve device 4, the cavity of form preferably being completely filled, the moment of closing being configured to prevent liquid 3 injected into the mould from reaching the height of the valve before it closes. In fact, the moment of closing of the valve is configured to prevent injection liquid passing through the valve, the effect of which would be to block the valve. The combination of suction of gas from the valve via the vacuum-generation system on the one hand and the pressure exerted by the piston 10 in motion injects the liquid material 3 at very high speed into the cavity of form 11 and fills all parts of the cavity 11 in a time period of the order or two orders of magnitude of thousandths of seconds. This ensures that there is only very little solidification of liquid material injected before complete filling of the mould, while having a mould for rapid cooling of the moulded item.

However, in a first suction and advancement phase of the piston 10, there is an advantage in controlling and especially slowing down suction before the liquid material 3 starts to pass through the output 9 to enter the cavity of form 11 of the mould, that is, more precisely from the moment when the piston 10 has closed the inlet 7 and up to the moment when the volume in the chamber 5 is reduced so that the injection liquid 3 fills this volume entirely. In fact, at the start of the injection procedure, the chamber 5 is not entirely filled with liquid 3. The advancement of the piston 10 reduced the available volume until the unfilled volume is eliminated. In this first die-casting injection phase, there is an advantage to being suctioned more slowly than in the second filling phase of the cavity of form 11 so as not to generate excessive perturbation in the liquid 3 contained in the reservoir 8 in the event where the sealing between the piston 10 and the chamber 5 is not ensured. The variation in suction speed can—in a first instance slowly and in a second instance more quickly —be controlled either by the valve device 4 or by adding extra valves to the principal valve 16 of the vacuum-generation system 6, or by a combination of both.

In the variant according to FIGS. 1 and 4*a*, the suction speed control is effected by the valve device 4. In the variant of FIG. 4*b*, the vacuum-generation system 6 comprises no valve and control of the suction is effected only by the valve device 4. In the system illustrated in FIG. 4*c* the vacuum-generation system 6 further comprises an escape valve 17 which partially opens the conduit between the principal valve 16 and the vacuum tank 14 to the ambient air to boost pressure and therefore decrease the suction effect under vacuum in the first injection phase. The escape valve 17 is preferably smaller than the principal valve 16, specifically, the escape valve has a diameter or the flow section is smaller than the diameter or the flow section of the principal valve 16. When the escape valve 17 is closed once the piston 10 will have advanced to eliminate the unfilled volume in the chamber 5 of the liquid reservoir 8, the leak created by the escape valve 17 is cancelled and the gas suction speed of the mould is increased.

According to the variant illustrated in FIG. 4*d*, the tank 14 of the vacuum-generation system is connected to the valve device 4 by two or three valves 16*a*, 16*b*, 16*c* or more which boost the suction speed as a function of the number of open valves. In the first suction phase, a single valve is for example open and then, when the piston is sufficiently advanced to eliminate the unfilled volume in the reservoir 8, the second or even the third valves are opened to enlarge the suction cross-section through the valves and boost the suction speed of gas from the mould.

According to the variant illustrated in FIG. 4*e*, the vacuum tank 14 of the vacuum-generation system is connected to the valve device 4 by two valves 16*a*, 16*b* of different sizes—a small valve 16*a* and a large valve 16*b*-which increase the suction speed as a function of the opening of the small valve 16*a* or of the large valve 16*b* or of both simultaneously. The advantage of this system is its simplicity of control, since there are only two valves to control, and it optimises the slow and rapid suction speeds by the dimensioning of the small valve 16*a*, respectively of the large valve 16*b*. In the first suction phase, the small valve 16*a* is open and then, when the piston is sufficiently advanced to partially eliminate the unfilled volume in the reservoir 8, the large valve 16*b* is opened to increase the suction cross-section and boost the gas suction rate of the mould. In an advantageous embodiment for current industrial applications, the large valve can advantageously have a diameter greater than 2.5 cm and the small valve a diameter less than 1.6 cm and greater than 0.5 cm.

According to a variant, a combination of the embodiments of FIGS. 4*c* and 4*e* is possible, specifically, the valve 17 connected to the atmospheric pressure is a small valve and the principal valve 16 a large valve.

In reference to FIG. 1, as a function of the volume of the liquid to be injected, and also to be able to employ the same valve device with several sizes of moulds or machines to be cast, the suction cross-section of the channel or output channels 15 of the mould connecting the cavity 11 to the valve device 4 can be varied to vary the resistance to suction of gas and to limit the quantity of metal in the chutes. A valve configured to large moulds and large extraction rates can therefore be used, also for smaller moulds by reducing the suction cross-section of the channel or output channels 15 of the mould. For example in die-casting, the same valve device can be used for mould volumes which can vary from 1 liter to 50 liters. This is a very large extension of the filed of application possible for a valve device with the advantage of allowing substantial economies in equipment and time and installation costs. In the case of small and average mould volumes, the capacity suction of the valve device or principal valves could advantageously be reduced by the methods described previously.

In reference now to FIGS. 2*a* to 3*b*, a valve device according to embodiments of the invention are illustrated. The valve device comprises a body 18 with a first part 28 defining a first block, and a second part 30 defining a second block, a sliding valve 20 mounted in a valve chamber formed in the body 18 and a valve seat 22, 22' cooperating with a valve head 44, 44' of the sliding valve to close, respectively open, the valve. The valve head 44' can have a conical surface complementary to a conical surface of the valve seat 22' such as illustrated in FIGS. 2*c* to 3*b*, or the valve head 44 can have a cylindrical surface complementary to a cylindrical surface in the valve seat 22 such as illustrated in FIGS. 2*a*, 2*b*.

The valve chamber 21 comprises a suction chamber 21*b* and a control chamber 21*a*. The control chamber 21*a* is connected to fluid control connections 26*a*, 26*b*, a connection 26*a* being for closing the valve and the other 26*b* for opening the valve. The fluid connections can especially be connected to a pneumatic or hydraulic system which can vary the pressure in the connections 26*a* and 26*b* to advance and return the sliding valve. The suction chamber 21*b* is connected to the gas discharge connection 24 connected to the vacuum-generation system 6.

The valve head is separable from the valve piston so as to allow the valve head to exit from the side of the plane of separation P of the mould without taking action on the control chamber 21*a*.

A sleeve 32 can be inserted into a cavity in the body 18, the valve 20 being mounted to slide in the sleeve 32, the sleeve 32 also defining the valve seat 22, 22'. The sleeve 32 is advantageously mounted removably in the body so it can be replaced or cleaned in maintenance operations. Also, the sleeve can also be made of material different to that of the body with optimal properties for decreasing friction forces and improving hermetic closing of the valve seat 22. The sleeve 32 which is subject to considerable wear due to the repetitive movements of the sliding valve and to repeated contact with the liquid from the side of the valve head 44 can be exchanged at low cost and without exchanging the body 18. The sleeve 32 can be held in the body by means of a circlip 46 or other removable fastening means such as screws.

Advantageously, the sliding valve comprises at least two separable parts, a first part 34 with a valve head 44, 44' cooperating with the valve seat 22, 22', and a second part 35 comprising a piston 38 mounted to slide in the control chamber 21*a* of the valve chamber 21. In the illustrated embodiments, the first and second sliding valve parts are joined together with removable fastening means 36, 36'. The valve head is separable from the valve piston so as to allow the valve head to be removed from the side of the face of the part of the mould (side plane of separation P) without acting on the control chamber.

In another variant (not illustrated), it is however also possible for the first and second parts of the sliding valve to be joined together by being screwed into each other, for example by having a male thread on a part engaged in a female thread in the other part. This latter variant can especially be utilised for small moulds or for plastic injection moulds.

The first part 34 of the sliding valve 20 can therefore be separated from the second part 35, to replace the first part or to clean or repair it, by leaving the second part 35 of the valve in the second part 30 of the body 18, without disassembly via the control chamber 21*a*. The first sliding valve part is removed from the side of the active face of the mould, that is, to the side of the plane of separation P of the parts of the mould, when the mould is open. The second block of the valve has a very high shelf life, since it is completely separate from the suction chamber 21*b* and protects any contaminants coming from the liquid injected into the mould. The second part of the sliding valve is also less subject to wear than the first valve part which slides in the sleeve and which engages the valve seat 22, 22'.

In removing the fastening means 36, 36', the first sliding valve part can therefore be separated from the second part during disassembly of the first and second blocks 28, 30 of the body to quickly and easily exchange the first valve part and/or the sleeve 32 in case of wear or damage.

In the example illustrated, the piston 38 is in the form of a cylindrical disc mounted sliding in the control chamber 21*a* which comprises a valve opening side 41 communicating with the opening fluid control connection 26*b*, and a closing side 43 communicating with the opening fluid control connection 26*a*, in one or the other of the connections as a function of the direction of preferred movement for applying pressure to the opening face side 40 or the closing face side 42 of the piston 38.

In the examples illustrated in FIGS. 2*a* to 3*a*, the pressure is differential to the extent where the surface of the face side closing 42 is lower than the surface of the face side opening 40 of the piston 38, the advantage being the capacity to regulate the differential pressure more finely, especially to better control the closing of the valve and boost the positioning stability of the sliding valve. The differential pressure especially compensates the pressure on the valve head 44, 44' during discharge of gas. As a function of the operating parameters of the device, if differential pressure is not preferred a non-differential variant can be realised such as illustrated in FIG. 3*b* where the support surface of the opening and closing sides of the piston 38 is equivalent or essentially equivalent.

The control chamber 21*a* is separated from the suction chamber by a wall 48 mounted in the second body part 30, an axis 50 of the second sliding valve part passing through a passage in the wall 48 to interconnect the piston 38 to the first part 34 of the sliding valve 20. The play between the passage and the axis is very slight so as to limit or eliminate a loss of load between the closing side of the control chamber 21*a* and the suction chamber 21*b*.

The axis 50 of the second sliding valve part is housed in a hole or a fork corresponding to the rear of the first valve part, the securing member in the embodiments of FIGS. 2*a*-2*d* being in the form of a pin 36 passing through a bore in the first part and in the second valve part. For inserting of the pin 36 in the bore of the two sliding valve parts, the body can comprise openings 52 on either side configured with an axial length A1 to allow axial displacement of the pin 36 from an open position to a closed position of the valve. The openings 52 can be closed by flat-bottomed screws mounted in screw holes in the body on either side of the pin and leaving slight clearance with the ends of the pin to enable it to move. To remove the first valve part, the two screws on either side are removed and the pin 36 is pushed from one side so that it exits from the other side to then simply axially withdraw the first valve part. The first valve part can therefore be separated very easily and very quickly, the pin nevertheless ensuring a very robust and rigid connection between the first and second valve parts.

The first part 28 of the body 18 can be separated from the second part 30 by loosening the screws 56 and lifting out the pin 36, such as described previously, with separation for lifting out the sleeve 32 also being very simple and rapid.

In a variant, the body has no opening on either side of the sliding valve, the pin being held by the seat of the valve, or by an O ring placed in a groove made in the valve á the position of the pin.

In another embodiment, illustrated in FIGS. 3*a* and 3*b*, the first and second sliding valve parts are joined together by way of a screw 36' extending axially from the rear of the sliding valve. If access from the rear is difficult or not preferred, it is also possible to have a central screw which is inserted from the side of the valve head 44 engaging in a thread in the second part 35 of the sliding valve.

The invention claimed is:

1. Suction valve device for die-casting machine comprising a mould with at least two separable mould parts, the suction valve device comprising a body with a valve chamber comprising a suction chamber and a control chamber, a sliding valve mounted in the valve chamber, the sliding valve comprising a first part with a valve head cooperating with a valve seat on the body for opening and closing of the valve, and a second part comprising a piston mounted in the control chamber, the control chamber being connected to fluid control connections for exerting pressure on the piston for controlling opening and closing of the valve, the second valve part and the first valve part being aligned on the same axis (A) in the direction of displacement of the sliding valve, the first and second parts of the sliding valve being separable, the suction valve device being configured to be arranged on one of said parts of the mould and oriented such that said axis (A) of the sliding valve is transversal to a plane (P) of separation of said mould parts, the first valve part being separable from the device from the side of said plane of separation (P) the first and second parts of the sliding valve being fixed together by a removable securing member comprising a pin or a key inserted transversally in an orifice passing through the first and second parts of the sliding valve.

2. The valve device according to claim 1 wherein the body comprises openings on either side of the sliding valve configured to allow axial displacement of the pin during opening or respectively closing of the valve.

3. The valve device according to claim 2 wherein the openings in the body are closed by screws mounted in threaded holes in the body configured to arrange the end of the screws with slight clearance of the ends of the pin to allow sliding of the pin.

4. The valve device according to claim 1, wherein it comprises a sleeve mounted in the chamber of the body defining a surface for guiding and sliding of the sliding valve, as well as the valve seat, the sleeve being mounted on the body.

5. The valve device according to claim 1, wherein the body comprises a first part and a second part, the first part being mounted removably to the second part, the first part comprising a connection for connection to a vacuum-generation system, and the second part comprising the control chamber.

6. The valve device according to claim 1, wherein the piston has an opening face with a surface larger than a closing face of the other side of the piston, configured to apply differential pressure on the piston compensating at least in part for pressure on the valve head during discharge of gas.

7. The valve device according to claim 1, wherein the valve head has a conical surface complementary to a conical surface of the valve seat.

8. The valve device according to claim 1, wherein the valve head has a cylindrical surface complementary to a cylindrical surface in the valve seat.

9. A die-casting system comprising a die-casting machine including a suction valve device and a vacuum-generation system comprising a vacuum tank larger than a volume of gas to be suctioned from a mould mounted on the machine, the suction valve device for die-casting machine comprising a mould with at least two separable mould parts, the suction valve device comprising a body with a valve chamber comprising a suction chamber and a control chamber, a sliding valve mounted in the valve chamber, the sliding valve comprising a first part with a valve head cooperating with a valve seat on the body for opening and closing of the valve, and a second part comprising a piston mounted in the control chamber, the control chamber being connected to fluid control connections for exerting pressure on the piston for controlling opening and closing of the valve, the second valve part and the first valve part being aligned on the same axis in the direction of displacement of the sliding valve, the first and second parts of the sliding valve being separable, the suction valve device being configured to be arranged on one of said parts of the mould and oriented such that said axis of the sliding valve is transversal to a plane of separation of said mould parts, the first valve part being separable from the device from the side of said plane of separation the first and second parts of the sliding valve being fixed together by a removable securing member comprising a pin or a key inserted transversally in an orifice passing through the first and second parts of the sliding valve.

10. The system according to claim 9 wherein the vacuum-generation system comprises at least one principal valve for controlling opening and closing of the connection to the tank and the valve device.

11. The system according to claim 10, wherein the vacuum-generation system comprises a plurality of principal valves between the vacuum tank and the valve device, the principal valves able to be controlled independently for delayed opening or closing to control the suction rate.

12. The system according to claim 11, wherein there is a small valve and a large valve which modify the suction rate as a function of the opening of the small valve or of the large valve, or of both simultaneously.

13. The system according to claim 12, wherein the large valve has a diameter greater than 2.5 cm and the small valve has a diameter less than 1.6 cm and greater than 0.5 cm.

14. The system according to claim 9, wherein the vacuum-generation system comprises at least one valve connected to the atmospheric pressure for decreasing the suction rate during a first injection phase.

* * * * *